United States Patent [19]

Wilson et al.

[11] 4,248,272

[45] Feb. 3, 1981

[54] SHED SENSING STOP MOTION SYSTEM FOR HIGH SPEED LOOMS

[75] Inventors: Marlin V. Wilson, Barboursville, Va.; Larry C. Nickell, Lewisburg; John L. McCormack, Fairlea, both of W. Va.

[73] Assignee: Appalachian Electronic Instruments, Inc., Ronceverte, W. Va.

[21] Appl. No.: 88,284

[22] Filed: Oct. 25, 1979

[51] Int. Cl.[3] ..... D03D 51/28; G01N 21/28

[52] U.S. Cl. ..... 139/353; 250/561

[58] Field of Search ..... 139/336, 352, 353, 370.1, 139/370.2; 250/559, 560, 561, 562, 563; 66/157, 161

[56] References Cited

U.S. PATENT DOCUMENTS

| | | | |
|---|---|---|---|
| 2,279,675 | 4/1942 | Gutman | 139/336 |
| 3,379,225 | 4/1968 | Ichimi et al. | 139/353 |
| 3,818,236 | 6/1974 | Lind et al. | 250/561 |
| 3,902,534 | 9/1975 | Nishiguchi et al. | 139/353 |
| 3,989,068 | 11/1976 | Kakinaka | 139/353 |
| 4,177,838 | 12/1979 | Wilson et al. | 139/353 |

*Primary Examiner*—Henry Jaudon

*Attorney, Agent, or Firm*—Mason, Fenwick & Lawrence

[57] ABSTRACT

Automatic loom stopping apparatus for detecting yarn breakage or improper shedding defects and generating loom stop signals to be associated with a loom comprising two or three vertically spaced monitoring light beam units forming horizontal transverse light beams perpendicular to the warp yarns spanning the warp yarn path. One of the beams forms a center beam located to pass through the open shed and the other beam or beams located to be interrupted by or both of the shed sheets occupying the upper or lower limit shed positions. Detector signals responsive to interruption of the light beams by yarns are processed and applied to gating circuits and NOR or AND circuits to detect yarn breakage, broken heddles, and other shedding defects.

22 Claims, 5 Drawing Figures

Fig-1
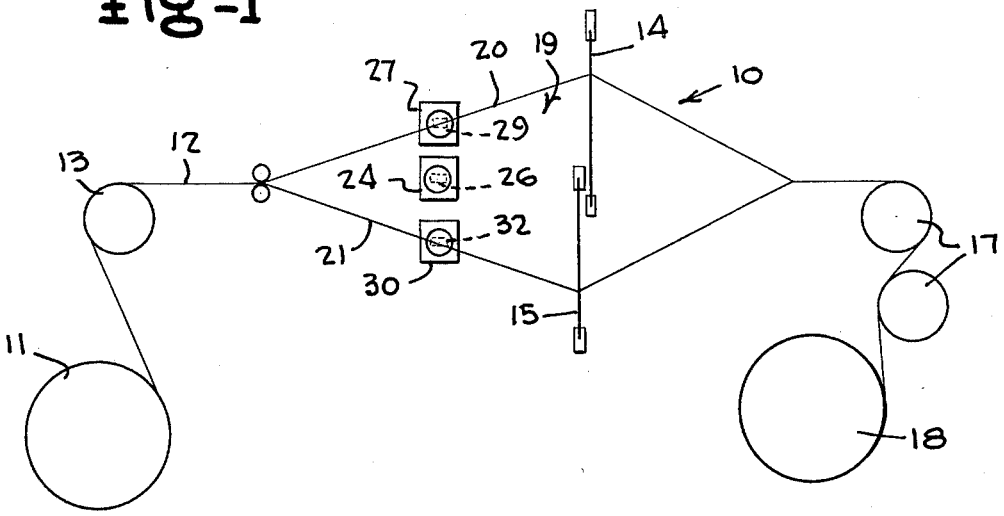
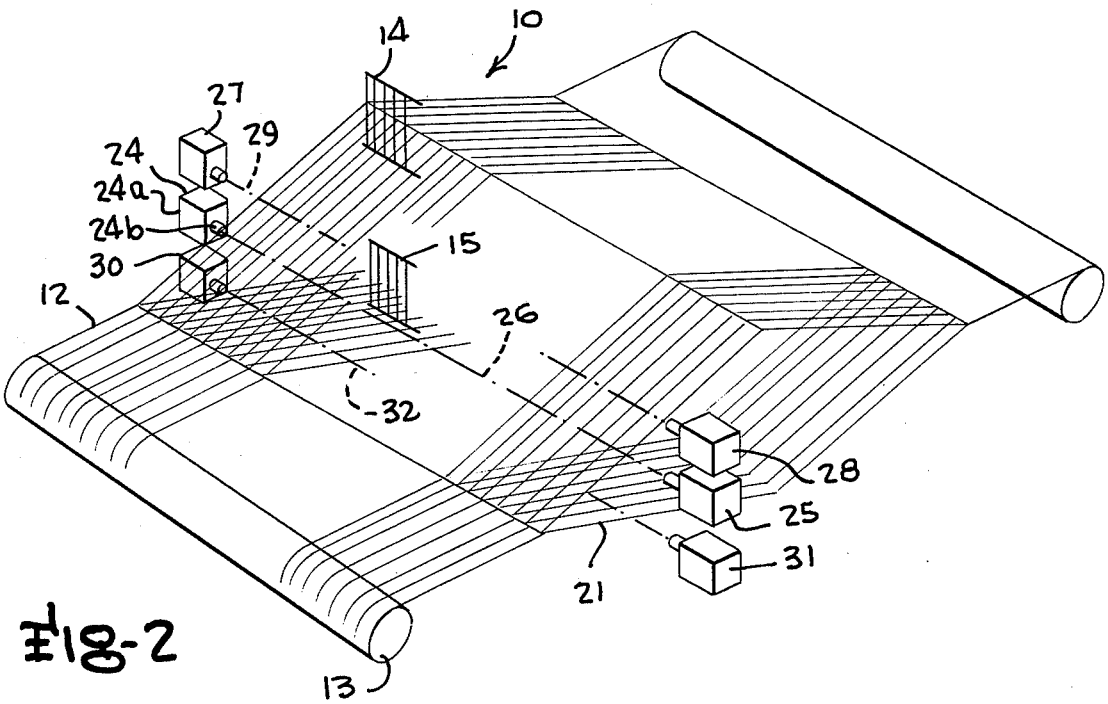
Fig-2

SHED SENSING STOP MOTION SYSTEM FOR HIGH SPEED LOOMS

BACKGROUND AND OBJECTS OF THE INVENTION

The present invention relates in general to automatic stop motion apparatus for looms for detecting broken warp yarns and broken heddles, and more particularly to electro-optical apparatus for electrically stopping high speed looms when a broken thread defect or the like occurs in the warp threads on the loom in a thread supply direction from the heddle zone or when a broken heddle occurs, by providing monitoring light beams at positions to pass through the open shed of the warp sheet and at positions to be interrupted by the upper and lower yarn sheets when the shed is open, and detecting variations in the light beams by photoelectric detector heads and electronic circuitry which responds only to predetermined combinations of light conditions at the monitoring beam stations to produce a stop signal.

Heretofore, the most prevalent stop motion apparatus for detecting defects in the warp shed formed by a loom have been of the drop bar or drop wire type, involving a thin flat plate or the like which is suspended for each warp thread at a predetermined location along the wrap sheet and is designed to fall from the supporting warp thread or yarn at the time the break of the corresponding warp thread occurs. Usually, the drop wires are positioned behind the heddle frames so that there necessarily occurs a lag in detection and hence in the stopping of the loom, allowing a lag time wherein the broken yarn end has the opportunity to entangle around the adjacent threads and form an improper warp shed which causes the formation of floats or distortions which disturb regular shedding motion of the warp yarns and produce weaving defects in the resultant fabric. Such floats have often prevented the drop wires of the conventional warp stop motion system from falling down, so that the warp stop motion is rendered inoperative in these instances.

More recently, electrical or electro-optical warp loom stop motion systems have been proposed. U.s. Pat. No. 2,279,675 to Gutman discloses a warp stop motion system wherein a beam of light is projected transversely relative to the warp sheet at a position to pass through the open shed when the warp sheet is in open position, together with a photoelectric detector and a mechanism which is controlled in timed relation to the rotation of the main drive shaft of the loom and thus in predetermined time relation with the opening of the shed to permit defect signals from the photoelectric detector to operate the loom stop mechanism only when the shed is in a predetermined open condition, thus preventing the photodetector from activating the stop mechanism and producing false stops when the shed is substantially closed. Later U.S. Pat. Nos. 3,379,225 and 3,989,068 have disclosed electro-optical stop motion systems for looms wherein a light beam projector and photodetector are both mounted on the moving sleigh of the loom which executes fore-and-aft movements through the open space defined by the open shed to detect threads or defects improperly occurring in the open shed during certain portions of the cycle of operation of the loom to produce a loom stopping signal. Of course, the positioning of the light beam producing optics, the photodetector head optics, and such electronic preamplifier circuitry and the like associated with the latter which needs to be mounted on the moving sleigh introduces significant maintenance problems and renders it difficult to provide loom stop motion systems in this manner which remain reliable for relatively long service life periods.

Other systems have been proposed to alleviate the problem encountered in providing a reliable loom stop motion system having adequate service life characteristics such as U.S. Pat. No. 3,818,236 wherein the optical beam is continuously rotated about a horizontal axis along a cylindrical path centered in the open shed and having a large enough diameter to deliberately intersect the upper and lower yarn sheets of the shed four times during each revolution and thereby produce signals which can be processed by circuitry for detecting when additional beam intercepts of thread occur to stop the loom. Also, U.S. Pat. No. 3,902,534 discloses a stop motion system wherein a monitoring light beam is disposed below the lowermost yarn sheet of the shed at the shed opening position and the lowermost yarn sheet is disposed adjacent a rotating brush cylinder close to or in contact with the warp yarn so that when a warp yarn is broken it is immediately arrested by the bristles of the brush and wrapped around the cylinder drawing the broken yarn through the monitoring light beam to activate the stop motion.

An object of the present invention is the provision of a novel stop motion system for looms, wherein a first stationary defect monitoring light beam is projected transversely of the yarn sheet through the open shed and detected by a photodetector head, at least one positioning monitoring light beam and photodetector detects the upper and/or lower shed yarn sheets to sense when the shed is open, and wherein novel electronic circuitry is provided for processing the signal produced by the defect monitoring photodetector head to provide an effective processing window for such signals which occurs during a short predetermined time when the shed is open, so as to permit sensing of defect signals only when the shed is in a predetermined open phase, and wherein means are provided to disable the system from producing false stop signals for a predetermined period after machines start up.

Another object of the present invention is the provision of a novel stop motion system for looms, wherein three stationary defect monitoring light beams are projected transversely of the yarn sheet, one through the center position which is unobstructed for a normal open shed, and the other two at upper and lower shed yarn sheet positions, each of which are detected by respective photodetector heads, to sense when the shed is open or obstructed and when the upper and lower shed yarn sheets are in proper position, and wherein novel electronic circuitry is provided for processing the signals produced by the photodetector heads and comparisons are made to permit sensing of defect signals only when the shed is in a predetermined open phase and when additional signals occur indicating either that obstructions occur in the central normally open shed position or when broken heddle defects occur.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a diagrammatic side view of the shed and principal components of a loom incorporating the present invention;

FIG. 2 is a fragmentary perspective view of the shed and the projector and detector units of the optical system associated with the broken yarn monitoring beam;

DETAILED DESCRIPTION OF A PREFERRED EMBODIMENT

Figure 3:
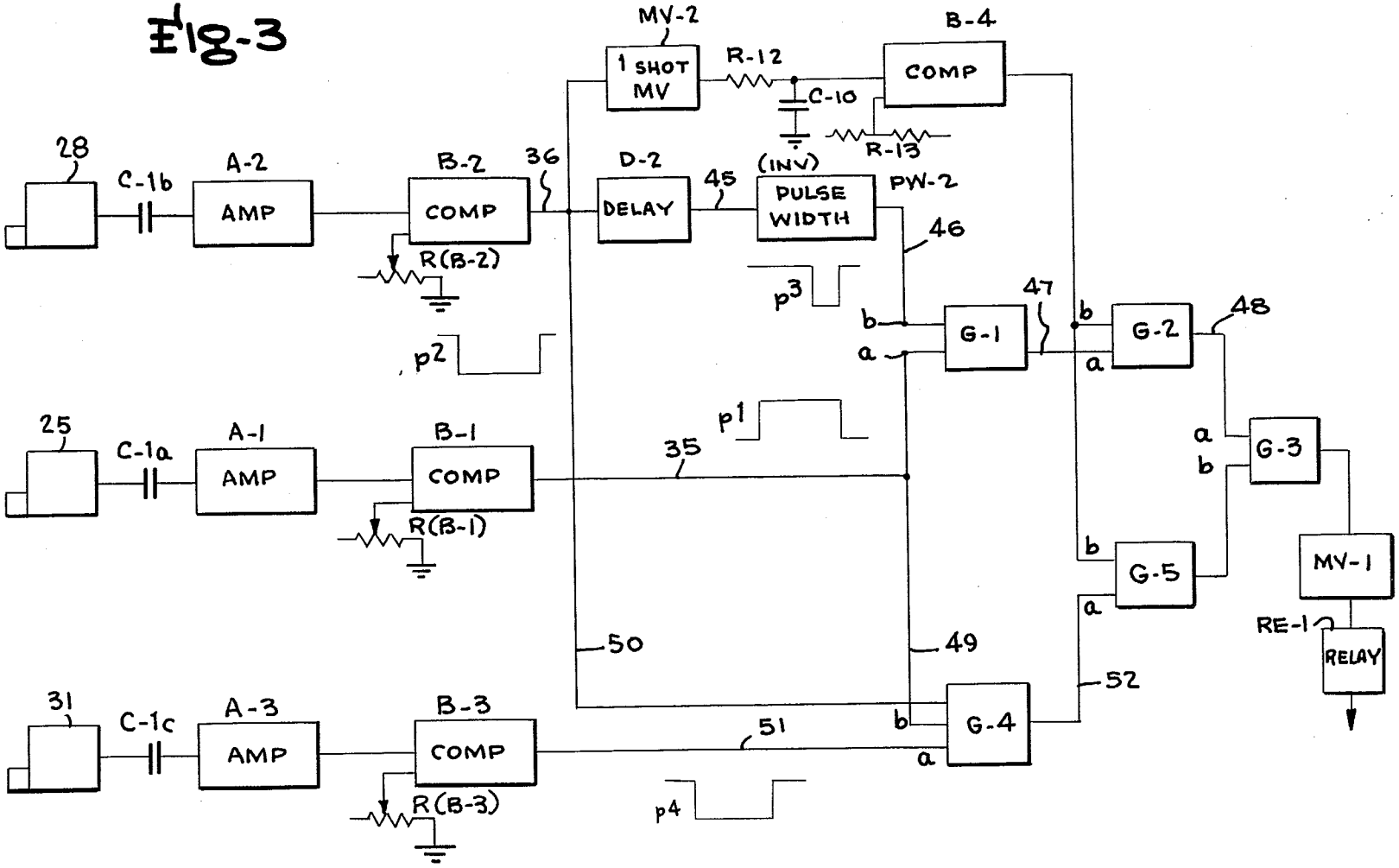
FIG. 3 is a block diagram of the broken yarn detector electronic system.

Referring to the drawings, wherein like reference characters designate corresponding parts or components throughout the several figures, the broken yarn detector and loom stop motion system of the present invention is designed to be used with conventional looms or high speed looms of the water jet type or other known types, such as the loom generally indicated by the reference character 10. Conventionally, such looms comprise a warp beam 11 containing the wound supply of warp yarns or threads for the weaving operation, from which the warp threads are drawn in a supply yarn sheet 12 of many parallel warp yarns in a single plane over a guide roll, sometimes referred to as a whip roll or back beam, indicated at 13, and fed through heddle eyes or the like, of heddles indicated diagrammatically at 14,15 and then through reeds 16 and over a roll or system or rolls, indicated at 17, to the cloth roll 18. The heddles 14,15 are moved vertically in timed relation in a well known manner to raise and lower the alternate subsets or shed sheets of warp yarns to open the shed or shuttle traversing space 19 thus formed between the upper and lower shed sheets of warp yarns indicated at 20 and 21 and change the shed 19 to reverse the positions of the shed sheets of yarns 20,21 between successive passes of the shuttle or other means for feeding the weft yarn across the warp yarn sheet. Thus the shed is closed for two short periods during each cycle of operations as the shed sheets 20,21 pass through the midplane of the shed when the positions of the shed sheets 20,21 are reversed by the raising and lowering of the heddles 14,15.

It will be appreciated that any broken warp yarn ends which occur during the weaving operation upstream of the heddles would either fall by gravity or be swung by shedding movement of the heddles through the space between the upper and lower shed sheets or would become entangled with another warp yarn or yarns and cause improper shedding of the thus entangled warp yarn or yarns.

In order to detect such a falling or abnormally positioned broken yarn end or improper shedding of the entanged unbroken warp yarns, a defect monitoring beam system, forming the first of three monitoring beams in the apparatus, is provided by the present invention to optically monitor the open shed space in a zone located somewhat toward the yarn supply or warp beam end of the loom from the heddles, at a location where the light beam would not be interrupted by shed yarns or warp yarns if no broken ends were to occur when the shed was open, but in a region where any broken yarn ends would either fall through the defect monitoring light beam or would entangle with adjacent unbroken warp yarns and change their position during shedding in a manner such that they would interrupt the monitoring light beam. As illustrated diagrammatically in FIGS. 1 and 2, the defect monitoring light beam in the illustrated embodiment is formed by a defect beam light projector or transmitter 24 located adjacent one longitudinal side of the warp yarn sheet, for example a light source having a housing **24*a* and lens tube 24*b* and an internal lamp forming a substantially collimated beam or a bundle of light rays having very slight divergence, masked to have a horizontally elongated cross-sectional configuration such that its width is about twice its height by a conventional beam shaping mask in the lens tube. A defect beam light detector or receiver, such as a photodetector head 25, is provided adjacent the opposite longitudinal side of the warp yarn sheet in the path of the projected light beam, indicated at 26, to detect variations in the light intensity of the defect monitoring light beam 26 and produce output electrical signals representative of the received light intensity and containing signal variations indicative of any warp yarn interruptions of the defect monitoring beam 26. For example, an optical system arranged by suitable masking at the projector of the light source to provide a defect monitoring beam having a cross-sectional width horizontally of about one inch and a vertical height of about one-half inch, located at a position along the warp yarn path toward the supply end where the shed sheets 20,21 have a vertical separation of about one inch has been found to be very satisfactory. Instead of using a separate light projector or transmitter 24 and photodetector 25 at opposite sides of the warp yarn path, one may alternatively use a combination light projector and detector and semi-transparent mirror system, such as the retroreflection detector head disclosed in U.S. Pat. No. 3,530,690 issued to L. C. Nickell et al., at one side of the yarn path and a retroreflective target of the type disclosed in that earlier patent at the opposite side of the warp yarn path, to provide the defect monitoring beam 26. The defect monitoring light beam system made up of the projector 24 and photodetector 25, or of a combined light projector and detector at one side of the yarn path and a retroreflective target at the other side, are designed to produce a pulse signal each time the shed sheet yarns interrupt the light beam 26 and a defect signal when a broken end of a warp yarn, or an entangled unbroken warp yarn which is improperly shedded, interrupts the beam 26. The defect signal produced by the photodetector will be of a short duration, rapidly changing nature resembling a negative-going pulse or AC signal, since the broken end merely falls or "dances" through the defect monitoring beam 26** or the entangled unbroken warp yarn which is being raised and lowered by the heddles only interrupt the light beam for a brief moment.

A similar upper monitoring beam system is also provided, made up of the projector 27 similar to the projector 24, and the photodetector 28, like the photodetector 25, or a combined light projector and photodetector at one side of the yarn path and a retroreflective target at the other side, as previously described, provides the upper defect monitoring beam 29, and is designed to produce a pulse signal when the upper shed sheet of warp yarn 20 interrupts the beam. Similarly, a third light projector 30 and photodetector 31, or a combined light projector and detector at one side of the yarn path and a retroreflective target at the other side as previously described, provide a lower monitoring beam 32 which is interrupted by the lower shed sheet of warp yarns 21 when the shed is properly opened, but wherein a distinctive signal is produced when a broken heddle occurs. The electrical signals produced by the photodetectors 28 and 31 will ordinarily be a negative-going pulse of predetermined duration determined by the dwell period of the upper and lower shed sheets at the upper and lower positions interrupting the monitoring beams 29 and 32.

Referring now to FIG. 3 showing in block diagram form the electronic circuit for the loom stop motion system of the present invention, the center channel photodetector or light beam receiver 25 is coupled to a variable gain amplifier A-1 through a coupling capacitor C-1*a* to amplify the pulse type signals generated by the detector head 25 and the defect signals produced when the broken warp yarn end interrupts the light beam 26 directed through the open shed 19. The monitoring light beam 26, as previously described, may have a vertical dimension of about ½ inch and a horizontal dimension of about 1 inch, provided by masking of the light beam, and may be located at a position along the yarn path where the upper and lower sheets 20,21 have a separation of about 1 inch. The output from the variable gain amplifier A-1 is applied to a comparator B-1 whose threshold is regulated by the potentiometer or manually adjustable resistor R (B-1), providing an output pulse p1 along a lead 35 to a first gate G-1. The upper monitoring beam signal processing channel for the upper shed yarn sheet 20 comprises a variable gain amplifier A-2 coupled through a coupling capacitor C-1*b* to the output of the detector head 28, the output of the variable gain amplifier A-2 if included, being applied to one of the inputs of the comparator B-2 whose threshold is regulated by the potentiometer or adjustable resistor R (B-2). If the variable gain amplifier A-2 is omitted, the output from the detector head 28 is applied directly to the input of the comparator B-2. The output pulse p2 from the comparator B-2 on the lead 36 is applied to a delay stage D-2 and thence through a pulse width adjusting stage PW-2 which adjusts the width of the pulse produced by the output of the photodetector 28 and inverts the same and applies it as the other input to the gate G-1.

Broadly speaking, the upper shed channel formed of the detector head 28, amplifier A-2, comparator B-2, delay D-2 and pulse width stage PW-2 form a negative-going window pulse p3 of shortened duration relative to the pulse produced by the photodetector 25 and comparator B-1, so as to form a gating window at the input of gate G-1 occurring substantially in the midregion, time-wise, of the pulse p1 supplied on the output lead 35 of the center channel comparator B-1, so that if an interruption occurs, due to a broken yarn, in the center monitoring beam 26, the input a to the gate G-1 from the output lead 35 of the center channel comparator B-1 will be low when the input b to the gate G-1 from the output of the pulse width stage PW-2 of the upper shed sheet channel is also low. The gate G-1 may be a NOR gate such that, if both inputs are low at the same time, its output goes high. The output of the NOR gate G-1 provides one of the inputs a to a second gate G-2 whose output provides an input a to another gate G-3 regulating a multivibrator MV-1 and relay RE-1 to stop the supply circuits for the loom or other device being monitored.

The monitoring beam 32 for the lower shed yarn sheet 21 is sensed by a lower signal processing channel made up of the photodetector head 31, a variable gain amplifier A-3 similar to the previously mentioned variable gain amplifiers, and a comparator B-3 similar to the previously mentioned comparators, regulated by a potentiometer or manually adjustable resistor R (B-3). The output pulse p4 of the lower channel capacitor C-1*c* forms an input a for a gate G-4, whose other input b is provided by signals from the middle channel comparator output lead 35. The output from the gate G-4 provides the input a to another gate circuit G-5, whose other input b, like the input b for the gate circuit G-2, is derived from the machine start up gating circuit formed of a one-shot multivibrator MV-2 connected to the output 36 from the upper channel comparator B-2, together with a comparator B-4, producing a disabling signal on the b inputs to the gates G-2 and G-5 for a short start up period of several seconds after the machine is initially turned on, to disable the stop motion circuitry from producing a false stop signal until the machine is in steady state operation.

Figure 4:
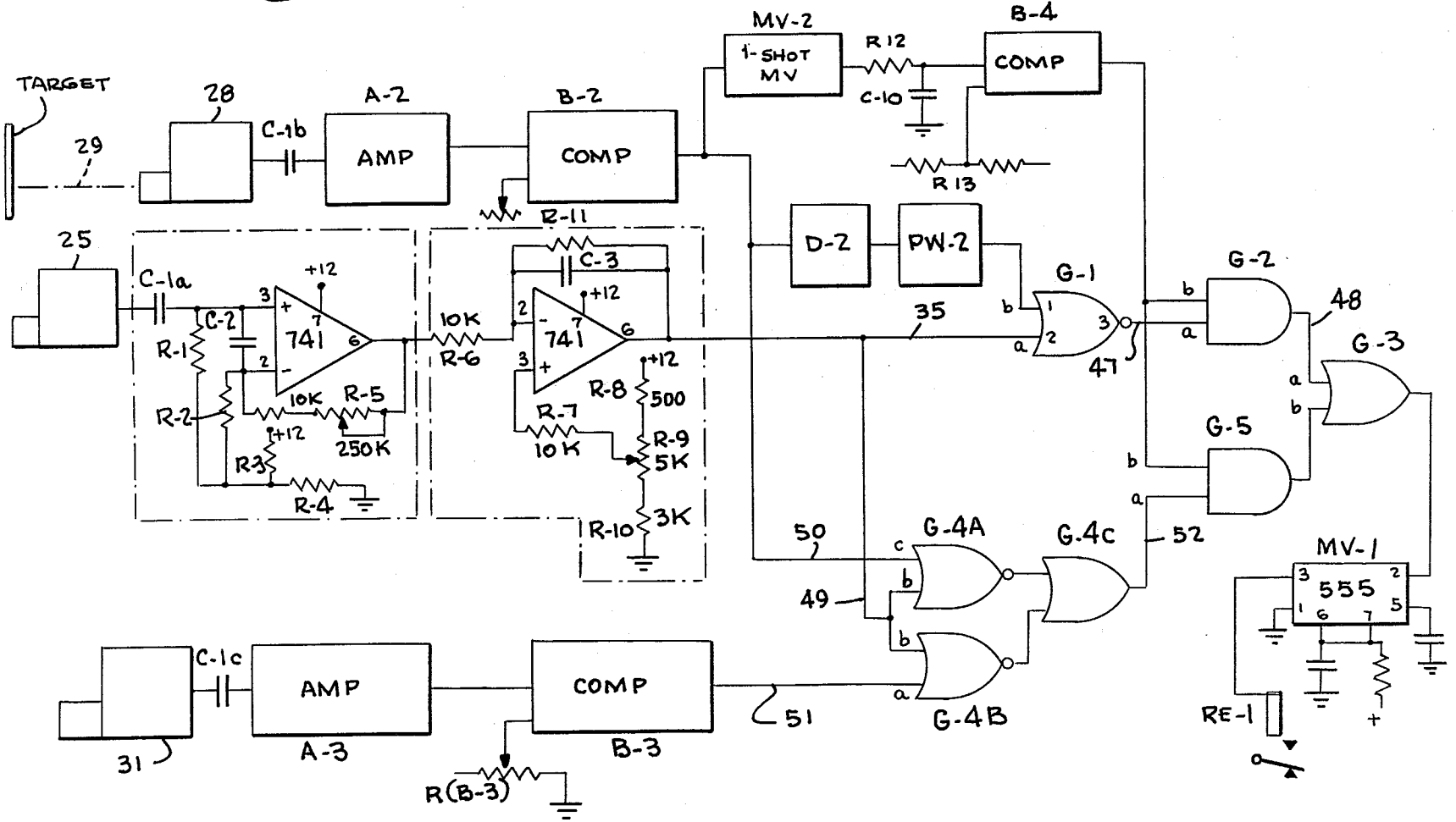
FIG. 4 is a schematic diagram of the electronic circuitry.

More specifically, referring to the schematic circuit of FIG. 4, showing a system wherein the beam producing components for each of the three monitoring beams 26, 29 and 32 are formed by a combination light projector and detector head unit of the type referred to as a retroreflective detector head, for example of the type disclosed in U.S. Pat. No. 3,530,690, which directs a beam of light from one side of the warp yarn path to the other toward a retroreflective target, and which then returns the light along the same beam path to a semi-transparent mirror in the detector head for reflection onto a photodetector, all as disclosed in said earlier patent. Since the variable gain amplifiers A-1, A-2 and A-3, and the comparators B-1, B-2 and B-3, of the center channel and the upper and lower channels are all alike, the schematic circuit for the variable gain amplifier A-1 and for the comparator B-1 are shown in detail in FIG. 4 for only the center or middle channel, it being understood the corresponding components A-2 and B-2 of the upper channel and A-3 and B-3 of the lower channel are made up of like schematic circuits. Referring to FIG. 4, the variable gain amplifier A-1 receives electrical signal output from the phototransistor or similar light sensitive element in the retroreflective photodetector head 25 from the reflected beam 26 returned by the associated retroreflective target, and provides a predetermind high signal state when the light beam is not interrupted by the shed crossing or by a broken end and produces a negative-going pulse when the shed yarns cross the beam when the shed is closed or when the beam is interrupted by a broken end. The signal output from the photodetector head 25 is coupled through an AC coupling capacitor C-1 for passing the wave form without DC biases getting into the effect. The amplifier A-1 comprises an operational amplifier 40 (which may be a UA 741 Op. Amp. made by Fairchild Semiconductor Co.) which is connected to form the variable gain amplifier A-1 by the resistors R-1 to R-5 and capacitor C-2. The resistors R-1 and R-2 connected to the input pins 3 and 2 of operational amplifier A-1 insert a DC bias into the amplifier so that the output with zero input is about +4 volts. The +4 volt level is fixed by the resistors R-3 and R-4. The capacitor C-2 connected across the input terminals is provided to prevent oscillations, and the variable resistor R-5 connected between the output pin 6 and the input pin 2 sets the minimum gain at which the amplifier will work. This minimum gain is usually about 0.5. The resistor R-5 allows one to go up to a maximum gain of about 12.5.

The output from the pin 6 of the amplifier 40 is connected through resistor R-6 to pin 2 of the operational amplifier 41 connected to form the comparator B-1. The operational amplifier 41 may also be a UA 741 Op. Amp. used as a comparator by the connections shown. Resistors R-8, R-9 and R-10 provide a threshold set network for operational amplifier 41, the resistor R-9 being a potentiometer whose wiper or movable contact is connected through resistor R-7 to the input pin 3 of operational amplifier 41. The potentiometer R-9 is adjusted to supply a threshold level signal to the plus or pin 3 input for the operational amplifier 41. Resistor R-11 and capacitor C-3 provide an RC feedback circuit to stabilize operational amplifier 41 against oscillation and permit very high gain amplification without oscillation. The first gate G-1 is formed of a NOR gate, having its input pin 2 forming input a referred to in FIG. 3 connected through lead 35 to the output pin 6 of the comparator 41, which goes to about +12 volts when a defect signal is produced or when the shed crosses. The NOR gate G-1 (or negative OR gate) may be part of an integrated circuit such as an RCA Integrated Circuit CD 4011 AE (having a built-in threshold of several volts). The upper channel associated with the beam 29 which is interrupted by by the upper shed yarns when the shed is in fully open position, (as shown in FIG. 2) includes the variable gain amplifier A-2 and comparator B-2 like the corresponding components just described for A-1 and B-1, but additionally includes the adjustable delay circuit D-2, which may be formed for example from a National Semiconductor 555 Integrated Circuit having an adjustable potentiometer connected to pin 6 of the multivibrator to adjust the delay time between the negative-going leading edge of the pulse generated on the output lead 36 of comparator B-2 and the negative-going leading edge of the delay pulse provided on the output lead 37 from the delay stage D-2. Also, the pulse width adjustment inverter stage PW-2 may be a variable width one-shot multivibrator, also formed, for example, of a 555 Integrated Circuit, having an adjustable potentiometer connected to the pins 6 and 7 thereof to produce a variable width negative pulse output responsive to the setting of its manually adjustable potentiometer for application to the other input 1 of gate G-1 forming input b of that gate.

The output pin 3 of the NOR gate G-1 is connected to the input pin of the gate G-2 formed of an AND gate, whose output pin is connected to an input pin of the OR gate G-3 providing one of the inputs thereof.

The lead 35 from the output pin of the central channel comparator B-1 is also connected by lead 49 to one of the two inputs of two NOR gates G-4A and G-4B together forming the gate G-4 referred to in the description of FIG. 3. The other input of NOR gate G-4A is connected by lead 50 to the output lead 36 of comparator B-2 for the upper channel, and the other input of the second NOR gate G-4B forming part of gate G-4 being connected to the output lead 51 of comparator B-3 associated with the photodetector 31 of the lower channel whose light beam is interrupted by the lower shed yarns in the fully opened position of the shed. The output from the two NOR gates G-4Aa and G-4B are connected to and form the two inputs of OR gate G-4C, the output of which is connected by lead 52 to form the input a of the AND gate G-5, the b input of which, like the b input of AND gate G-2, is connected to a delayed enable signal from the comparator B-4 of the machine start-up delay circuit. This machine start-up delay circuit includes the multivibrator MV-2, which may be a variable width one-shot multivibrator similar to the multivibrator forming the pulse width circuit PW-2, adjusted to provide positive pulses at its output responsive to interruption of the light beam 29 by the upper shed yarns connected to a network formed of resistor R-12 and capacitor C-10 to form one input of the comparator B-4, whose other input is connected to a voltage divider resistor pair R-13. In one satisfactory example, the capacitor C-10 is chosen to require enough successive pulses to bring the voltage level at the associated input of the comparator B-4 to a point causing the output of B-4 to go high and apply a voltage of about +10 volts to the b input of the gates G-2 and G-5. In practice, about two to three seconds of machine running after start-up are required to provide the high output of comparator B-4.

It will be appreciated that the timing of the open period or "gate window period" for the gate designed to pass to the defect detecting circuitry signals from the central channel comparator B-1 should be achieved in some manner to limit the signal passing or open window periods of the gate to a very short period when the shed 19 is in the midtime of its open condition, thus eliminating responding to portions of the shed open signals from the center beam detector 25 occurring during the changing conditions near the leading and trailing end portions of the high or positive-going pulse from comparator B-1 signifying shed open condition. Also, it is desirable that the system be disabled from indicating improper shedding or broken ends during the few seconds following initial start-up or reset start-up of the loom mechanism before the timing of loom machinery functions has stabilized at normal operating condition. In our earlier U.S. patent application Ser. No. 893,931 filed Apr. 6, 1978, this timing of the open periods or gate window periods was achieved by generating periodic timing signal pulses indicating rotation of the main drive shaft of the loom and processing signals derived from these timing signal pulses to correlate the gate window periods with the cycle of operation of the loom mechanism. In the present invention, there is no need to generate timing signal pulses derived from rotation of the main drive shaft of the loom, because the signals produced upon interruption of the upper beam 29 by the upper shed sheet 20 are delayed by the delay stage D-2 which delays the leading edge of the negative-going pulse generated at the output of comparator B-2 at the start of interruption of beam 29 by the upper shed sheet 20 to a time period beginning near the midregion of the positive-going pulse at the output of comparator B-1 which occurs during the period no yarns are interrupting the center beam 26 (i.e., for the duration of the shed open position). This delayed negative-going pulse at the output of delay stage D-2 is shortened to a desired pulse width, for example of about one-third the time duration of the shed open pulse on lead 35, by the pulse width multivibrator-inverter PW-2 and applied as the input b on pin 1 of the gate G-1, providing in effect a gate control signal (the pulse p3) which enables the output of the NOR gate G-1 to go high only when the other input a at pin 2 of NOR gate G-1 from the comparator B-1 is low, signifying that the central beam 26 is concurrently being interrupted, since NOR gate G-1 goes high only if both its inputs are low at the same time. Accordingly, if a defect occurs, as by a broken end falling into or through the center monitoring light beam 26 or improper shedding from entanglement occurs interrupting this beam while the "gate window period" established by the narrowed and delayed pulse p3 is low, the output of NOR gate G-1 goes high providing a high input for the input a of gate G-2. If the other input b to AND gate G-2 is high, which other input remains high once the start-up delay period has timed out, a high condition is provided on lead 48 to input a of the NOR gate G-3, causing its output to go low and triggering the one-shot multivibrator MV-1 to energize relay RE-1 and activate the stop motion circuit of the loom to terminate loom operation. If there is no interruption of the center monitoring beam 26 due to a broken warp end or improper shedding during the time period established by the delayed inverted gating pulse p3 at the input b of NOR gate G-1, input b of gate G-1 is low but input a from comparator B-1 is high, so that the output of NOR gate G-1 remains low and there is no activation of gates G-2 and G-3 to trigger the multivibrator MV-1. The multivibrator MV-1 may be a National Semiconductor 555 connected as shown, and may drive relay RE-1 directly or by a transistor circuit such as shown at T-1 and T-2 of FIG. 4 of our earlier application Ser. No. 893,931.

As previously described, during start-up of the loom, either initial start-up or following reset, the period of which is determined by the one-shot multivibrator MV-2 and the resistor-capacitor combination R-12 and C-10, the output of comparator B-4 remains low until the predetermined start-up time period, for example about three seconds, after which the voltage at the top of capacitor C-10 applied to the input a of comparator B-4 reaches a level of about +5 volts, causing the comparator B-4 to go high and thereby condition the AND gates G-2 and G-5 to provide a high output when the other input to either of these gates goes high.

The gates G-4 and G-5 and inverter I-1 permit automatic detection of broken heddle conditions and activation of the stop motion circuitry. This occurs by sensing when interruption of either the upper beam 29 or the lower beam 32 occurs by any yarns in the upper or lower shed positions when the normal yarns are crossing the center monitoring beam 26 at the shed closed position. As will be seen, any negative-going pulse p2 at the output of comparator B-2 responsive to upper shed sensing beam 29 being interrupted is applied by lead 50 to input c of NOR gate G-4A and any negative pulse output from comparator B-3 is applied by lead 51 to the input a of companion NOR gate G-4B. An "enable" signal is applied to the other input of each of these NOR gates G-4A and G-4B through inverter I-1 from the output of the center channel comparator B-1 at normal shed closed time when center beam 26 is blocked. Thus, when a broken heddle condition occurs, which leaves one or more yarns in the upper or lower beams 29 or 32 while the remaining yarns are moved through the center beam 26, a negative-going "enable" pulse p4 is applied from inverter I-1 through lead 49 to the associated inputs of gates G-4A and G-4B, signifying the shed moving through the center beam 26, and if a broken heddle condition exists, the output from either the upper channel comparator B-2 or the lower channel comparator B-3 will be low during this same period because of failure of one of the heddles to move its associated yarn to the center position. Accordingly, both inputs of one or the other of the two NOR gates G-4A or G-4B will be low at the same time, causing its output to go high and thus causing the output of OR gate G-4C to go high, activating gates G-5 and G-3 to trigger the one-shot multivibrator MV-1 and energize the stop motion relay RE-1.

Figure 5:
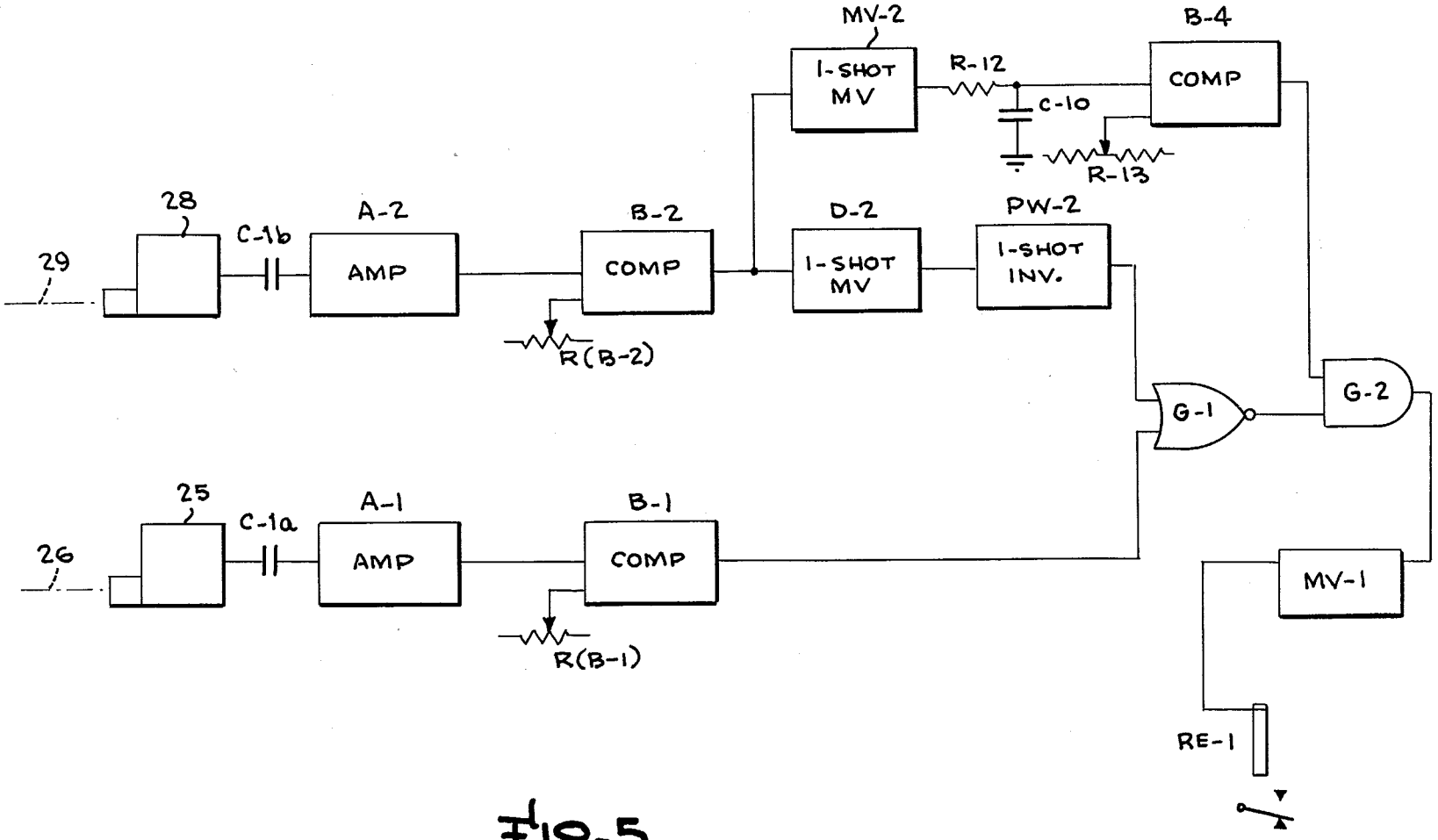
FIG. 5 is a block diagram of a modification of the system.

It will be apparent that one may modify the above described system by eliminating the channel including either the upper monitoring beam 29 or the lower monitoring beam 32 and provide merely a central channel including the central beam 26 as in the previously described embodiment, and provide an upper or a lower channel like the upper channel components associated with the beam 29 as in the previously described embodiment, to achieve detection of a broken yarn end or improper shedding and to provide the start-up delay feature, without including the broken heddle detection of the previously described embodiment. Such a modified form is shown in block diagram in FIG. 5, wherein the components corresponding to components of the previously described embodiment are indicated by the same reference characters as those used to designate the components in the FIGS. 1–4 embodiment. While the system shown in FIG. 5 employs a central monitoring beam 26 for the open shed position and an upper monitoring beam 29 for the upper shed sheet position, it will be appreciated that the system may employ a lower shed sheet monitoring beam located in the same position as the monitoring beam 32 instead of having the upper monitoring beam 29, and the signal processing circuitry associated with the lower monitoring beam 32 and its detector head 31 will be the same as that associated with the upper beam 29 and its detector head 28 in the FIGS. 1–4 embodiment.

What is claimed is:

1. Automatic loom stopping apparatus for detecting yarn breakage or improper shedding defects and generating loom stop signals to be associated with a loom wherein warp yarns are displaced during weaving in two shed sheets of yarn periodically to an open shed condition locating the shed sheets at upper and lower limit shed positions, the apparatus comprising at least two vertically spaced monitoring light beam units respectively including a first and second light detector positioned adjacent the warp yarn path between the supply end and the weaving zone of the loom and including means forming first and second horizontal transverse light beams perpendicular to the warp yarns spanning the warp yarn path, one of said light beams forming a center beam located to pass through the open shed to be interrupted by any portion of a warp yarn or broken end occurring when the shed is open and the second light beam being located to be interrupted by one of the shed sheets occupying the upper or lower limit shed positions, said detectors each having means providing detector signals responsive to interruption of the associated light beam by yarns passing therethrough, signal processing means for producing processed signals responsive to said detector signals including means for producing delayed and narrowed pulse signals from the detector signals of said second detector responsive to interruption of the second light beam by a shed sheet at the upper or lower limit shed position to produce a short duration window pulse during only a predetermined midtime portion of the period when the shed is open, a first gate circuit receiving the processed signals from said first detector and the window pulses for producing a gate defect signal when yarn defects causing interruption of said first light beam occur during the open shed periods signified by the window pulses, and stop relay means activated responsive to said gate defect signals to stop the loom.

2. Automatic looms stopping apparatus as defined in claim 1, including start-up delay signal means receiving processed signals produced responsive to detector signals from said second detector signifying yarn sheet interruption of said second beam at the upper or lower limit shed positions for producing a gate enable signal commencing at a predetermined delay time following loom start-up or restart, and a second gate circuit responsive to concurrence of said gate enable signals and said gated defect signals to produce output stop signals to activate said stop relay means.

3. Automatic loom stopping apparatus as defined in claim 2, wherein said signal processing means for each of said detectors includes a comparator circuit receiving signals from said amplifier means and having a threshold set network including an adjustable potentiometer establishing a threshold voltage level which signals from the amplifier means must exceed to produce said processed defect signal applied to said first gate circuit.

4. Automatic loom stopping apparatus as defined in claim 2, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other input thereof being connected to the output of said amplifier means.

5. Automatic loom stopping apparatus as defined in claim 2, wherein the processed signals produced from the detector signals of said first detector are a pulse of a first polarity for each shed opening having a duration corresponding to the open shed condition, and said window pulses are pulses of an opposite second polarity having a shorter duration than the first polarity pulses and each occurring only during a predetermined mid-time portion of a respective first polarity pulse, the occurrence of a defect-signifying interruption of the first beam producing a defect signal of said second polarity in said first polarity pulse.

6. Automatic loom stopping apparatus as defined in claim 5, wherein said first gate circuit includes a NOR gate having said first polarity pulses and window pulses applied to its input to produce said gate defect signal upon concurrence of a window pulse and defect signal both of said second polarity.

7. Automatic loom stopping apparatus as defined in claim 2, including a third gate circuit for receiving the processed second detector signals produced responsive to interruption of said second light beam and means for providing an enable signal for said third gate circuit from the processed signals from said first detector during the period the first light beam is interrupted by the yarns crossing the same during closed shed condition to cause the third gate circuit to produce an output signal responsive to concurrence of said enable signal and second detector processed signals indicative of broken heddle conditions in which yarn interrupts said second light beam when the first light beam is being interrupted by yarns crossing the same at closed shed condition, and an additional gate circuit responsive to outputs from said first gate circuit and said third gate circuit for activating the loom stopping means.

8. Automatic loom stopping apparatus as defined in claim 7, including a third light beam unit like said first and second light beam units having a third light detector and means forming a third light beam transverse to and spanning the yarn path, said second and third light beams being located to be interrupted by the shed sheets occupying the upper and lower limit positions respectively, signal processing means for processing detector signals from said third detector, means responsive to the yarns crossing said first light beam at closed shed condition for producing a gate enable signal, gate means receiving processed signals responsive to detector signals for said second and third detectors indicating yarns interrupting the second or third beams concurrently with occurrence of said gate enable signal to activate said stop relay means.

9. Automatic loom stopping apparatus as defined in claim 2, including a third light beam unit like said first and second light beam units having a third light detector and means forming a third light beam transverse to and spanning the yarn path, said second and third light beams being located to be interrupted by the shed sheets occupying the upper and lower limit positions respectively, signal processing means for processing detector signals from said third detector, means responsive to the yarns crossing said first light beam at closed shed condition for producing a gate enable signal, gate means receiving processed signals responsive to detector signals for said second and third detectors indicating yarns interrupting the second or third beams concurrently with occurrence of said gate enable signal to activate said stop relay means.

10. Automatic loom stopping apparatus as defined in claim 1, wherein said signal processing means for each of said detectors includes a comparator circuit receiving signals from said amplifier means and having a threshold set network including an adjustable potentiometer establishing a threshold voltage level which signals from the amplifier means must exceed to produce said processed defect signal applied to said first gate circuit.

11. Automatic loom stopping apparatus as defined in claim 10, wherein the processed signals produced from the detector signals of said first detector are a pulse of a first polarity for each shed opening having a duration corresponding to the open shed condition, and said window pulses are pulses of an opposite second polarity having a shorter duration than the first polarity pulses and each occurring only during a predetermined mid-time portion of a respective first polarity pulse, the occurrence of a defect-signifying interruption of the first beam producing a defect signal of said second polarity in said first polarity pulse.

12. Automatic loom stopping apparatus as defined in claim 11, wherein said first gate circuit includes a NOR gate having said first polarity pulses and window pulses applied to its input to produce said gate defect signal upon concurrence of a window pulse and defect signal both of said second polarity.

13. Automatic loom stopping apparatus as defined in claim 1, wherein said signal processing means includes a comparator circuit connected to receive output signals from said amplifier means and having an adjustable potentiometer for establishing a threshold signal level at the input thereof to cause the signal processing means to produce said processed defect signals only when output signals from the amplifier means exceed a predetermined threshold level, said comparator being formed of an operational amplifier with said potentiometer connected between its output and one of its inputs and the other input thereof being connected to the output of said amplifier means.

14. Automatic loom stopping apparatus as defined in claim 13, including a third gate circuit for receiving the processed second detector signals produced responsive to interruption of said second light beam and means for providing an enable signal for said third gate circuit from the processed signals from said first detector during the period the first light beam is interrupted by the yarns crossing the same during closed shed condition to cause the third gate circuit to produce an output signal responsive to concurrence of said enable signal and second detector processed signals indicative of broken heddle conditions in which yarn interrupts said light beam when the first light beam is being interrupted by yarns crossing the same at closed shed condition, and an additional gate circuit responsive to outputs from said first gate circuit and said third gate circuit for activating the loom stopping means.

15. Automatic loom stopping apparatus as defined in claim 1, wherein the processed signals produced from the detector signals of said first detector are a pulse of a first polarity for each shed opening having a duration corresponding to the open shed condition, and said window pulses are pulses of an opposite second polarity having a shorter duration than the first polarity pulses and each occurring only during a predetermined mid-time portion of a respective first polarity pulse, the occurrence of a defect-signifying interruption of the first beam producing a defect signal of said second polarity in said first polarity pulse.

16. Automatic loom stopping apparatus as defined in claim 15, wherein said first gate circuit includes a NAND gate havig said first polarity pulses and window pulses applied to its input to produce said gate defect signal upon concurrence of a window pulse and defect signal both of said second polarity.

17. Automatic loom stopping apparatus as defined in claim 16, including a third gate circuit for receiving the processed second detector signals produced responsive to interruption of said second light beam and means for providing an enable signal for said third gate circuit from the processed signals from said first detector during the period the first light beam is interrupted by the yarns crossing the same during closed shed condition to cause the third gate circuit to produce an output signal responsive to concurrence of said enable signal and second detector processed signals indicative of broken heddle conditions in which yarn interrupts said second light beam when the first light beam is being interrupted by yarns crossing the same at closed shed condition, and an additional gate circuit responsive to outputs from said first gate circuit and said third gate circuit for activating the loom stopping means.

18. Automatic loom stopping apparatus as defined in claim 15, including a third gate circuit for receiving the processed second detector signals produced responsive to interruption of said second light beam and means for providing an enable signal for said third gate circuit from the processed signals from said first detector during the period the first light beam is interrupted by the yarns crossing the same during closed shed condition to cause the third gate circuit to produce an output signal responsive to concurrence of said enable signal and second detector processed signals indicative of broken heddle conditions in which yarn interrupts said second light beam when the first light beam is being interrupted by yarns crossing the same at closed shed condition, and an additional gate circuit responsive to outputs from said first gate circuit and said third gate circuit for activating the loom stopping means.

19. Automatic loom stopping apparatus as defined in claim 15, including a third light beam unit like said first and second light beam units having a third light detector and means forming a third light beam transverse to and spanning the yarn path, said second and third light beams being located to be interrupted by the shed sheets occupying the upper and lower limit positions respectively, signal processing means for processing detector signals from said third detector, means responsive to the yarns crossing said first light beam at closed shed condition for producing a gate enable signal, gate means receiving processed signals responsive to detector signals for said second and third detectors indicating yarns interrupting the second or third beams concurrently with occurrence of said gate enable signal to activate said stop relay means.

20. Automatic loom stopping apparatus as defined in claim 1, including a third gate circuit for receiving the processed second detector signals produced responsive to interruption of said second light beam and means for providing an enable signal for said third gate circuit from the processed signals from said first detector during the period the first light beam is interrupted by the yarns crossing the same during closed shed condition to cause the third gate circuit to produce an output signal responsive to concurrence of said enable signal and second detector processed signals indicative of broken heddle conditions in which yarn interrupts said second light beam when the first light beam is being interrupted by yarns crossing the same at closed shed condition, and an additional gate circuit responsive to outputs from said first gate circuit and said third gate circuit for activating the loom stopping means.

21. Automatic loom stopping apparatus as defined in claim 20, including a third light beam unit like said first and second light beam units having a third light detector and means forming a third light beam transverse to and spanning the yarn path, said second and third light beams being located to be interrupted by the shed sheets occupying the upper and lower limit positions respectively, signal processing means for processing detector signals from said third detector, means responsive to the yarns crossing said first light beam at closed shed condition for producing a gate enable signal, gate means receiving processed signals responsive to detector signals for said second and third detectors indicating yarns interrupting the second or third beams concurrently with occurrence of said gate enable signal to activate said stop relay means.

22. Automatic loom stopping apparatus as defined in claim 1, including a third light beam unit like said first and second light beam units having a third light detector and means forming a third light beam transverse to and spanning the yarn path, said second and third light beams being located to be interrupted by the shed sheets occupying the upper and lower limit positions respectively, signal processing means for processing detector signals from said third detector, means responsive to the yarns crossing said first light beam at closed shed condition for producing a gate enable signal, gate means receiving processed signals responsive to detector signals for said second and third detectors indicating yarns interrupting the second or third beams concurrently with occurrence of said gate enable signal to activate said stop relay means.

* * * * *